United States Patent [19]

Takegawa

[11] Patent Number: 4,481,983

[45] Date of Patent: Nov. 13, 1984

[54] WEFT RESERVOIR FOR FLUID-JET LOOMS

[75] Inventor: Yujiro Takegawa, Ishikawa, Japan

[73] Assignee: Tsudakomo Kogyo Kabushiki Kaisha, Japan

[21] Appl. No.: 491,562

[22] Filed: May 4, 1983

[30] Foreign Application Priority Data

May 10, 1982 [JP] Japan ..... 57-77985

[51] Int. Cl.[3] ..... B65H 51/20

[52] U.S. Cl. ..... 139/452; 242/47.1; 242/47.12

[58] Field of Search ..... 139/452; 242/47.01, 242/47.12

[56] References Cited

U.S. PATENT DOCUMENTS 4,132,370 1/1979 Mullekom ..... 242/47.12
4,381,807 5/1983 Umezawa et al. ..... 139/152
4,397,340 8/1983 Umezawa et al. ..... 242/47.01

FOREIGN PATENT DOCUMENTS 0080692 6/1983 European Pat. Off. ..... 139/452

*Primary Examiner*—Henry S. Jaudon
*Attorney, Agent, or Firm*—Lerner, David, Littenberg, Krumholz & Mentlik

[57] ABSTRACT

In construction of a pin control type weft reservoir, a control pin once registered at a stand-by position upon initiation of weft insertion is brought to an operative position right after the initiation of weft insertion for simple adjustment in operation timing of the control pin and for successful separate reservation of weft on the reservoir drum without any substantial ill influence of weft slack caused by the provisional recession of the control pin.

15 Claims, 5 Drawing Figures

WEFT RESERVOIR FOR FLUID-JET LOOMS

BACKGROUND OF THE INVENTION

The present invention relates to a weft reservoir for fluid-jet looms, and more particularly relates to improvement in construction of a weft reservoir of a type on which a weft is wound for prescribed times on a reservoir drum made up of conical and cylindrical sections by means of a yarn guide rotating in synchronims with loom rotation and subsequently supplied to the main nozzle of the loom after reservation by operation of a control pin.

In the arrangement of the weft reservoir in accordance with the present invention, the side closer to the supply source of weft will hereinafter be referred to as "the upstream side" whereas the side closer to the main nozzle is referred to as "the downstream side".

In general, weft insertion starts at a crank angle between 90 to 110 degrees and terminates at a crank angle between 250 and 270 degrees. During this period, the weft is taken out from the weft reservoir first by free delivery and next, just before termination of the weft insertion, by controlled delivery. It is, however, assumed in the following description that the weft insertion in the present invention starts at about 90 degrees crank angle and terminates at about 270 degrees crank angle.

When registered at an operative position on the reservoir drum, the control pin comes in engagement with the weft and hinders its delivery from the reservoir drum. Whereas, when registered at a stand-by position, the control pin is placed out of engagement with the weft in order to allow its free delivery from the reservoir drum.

In one conventional weft reservoir of the above-described type, a control pin is arranged at the cylindrical section of the reservoir drum. This arrangement is usually called as "an internal type". The control pin is usually placed at a stand-by position taken within the reservoir drum, and is registered at an operative position taken outside the reservoir drum at a prescribed moment by operation of a proper cam drive mechanism. More specifically, the control pin advances from the stand-by position and advances into the operative position outside the reservoir drum by operation of the cam drive mechanism at about 270 degrees crank angle whereat a cycle of weft insertion terminates. On the upstream side of the control pin in this state, the weft is wound for reservation about the cylindrical section of the reservoir drum by operation of the rotary yarn guide. At about 90 degrees crank angle whereat the next cycle of weft insertion initiates, the control pin recedes into the reservoir drum and the weft reserved on the cylindrical section of the reservoir drum are subjected to delivery by traction of the main nozzle.

In addition to the controlled delivery of weft from the reservoir drum, the control pin is adapted for separated reservation of weft for respective weft insertion. One pick of weft usually includes several coils of weft wound on the reservoir drum. For example, four coils of weft wound on the reservoir drum form a pick of weft. At delivery, the coils of weft are sequentially delivered from the downstream side.

When the weft reservoir is equipped with a control pin arranged at the cylindrical section of the reservoir drum, the weft is reserved on the upstream side of the control pin on the cylindical section of a uniform diameter. So, even after the control pin has recedes into the reservoir drum, the coils of weft on the cylindrical section do not move in the axial direction of the reservoir drum and are sequentially subjected to delivery at respective positions at which they were initially wound on the cylindrical section. As a consequence, the control pin is not allowed to advance towards the operative position outside the reservoir drum for reservation of weft for the next cycle weft insertion until the coils of weft on the cylindrical section have all been unwound.

The yarn guide rotates periodically in synchronism with the loom rotation but quite independently of the above-described operation of the control pin, in particular its movement between the operative and stand-by positions. As a consequence, the control pin has to be brought to the operative position outside the reservoir drum after the final coil of weft for a certain cycle of weft insertion has been wound on the cylindrical section of the reservoir drum but before the yarn guide comes to the position of the control pin in order to wind the first coil of weft for the next cycle of weft insertion.

In other words, advance of the control pin to the operative position must be completed within an extremely short period from unwinding of the final coil of weft for a certain cycle of weft insertion to winding of the first coil of weft for the next cylce of weft insertion. It is highly difficult in pactice to properly adjust the timing of the above-described movement of the control pin. Even a misstep in the adjustment would disenable separated reservation of weft for respective weft insertion.

In order to remove the above-described inconveniencies inherent to the weft reservoir having a control pin arranged in the cylindrical section, it has been already proposed to use a pair of control pins on a weft reservoir. In the case of this proposed arrangement, the first control pin moves in the area of the conical section and the second control pin moves in the cylindrical section of the reservoir drum, both for control of weft wound on the reservoir drum. In addition to those movements, the pair of control pins reciprocate in the axial direction of the reservoir drum and pass by, at a certain timing, for transfer of weft.

More specifically, the pair of control pins cooperate in the following manner. Before the first cycle of weft insertion is initiated, the first pin in the conical section advances to the operative position outside the reservoir drum and the yarn guide starts reservation of weft for the second cycle of weft insertion on the conical section on the upstream side of the control pin registered at the operative position. At about 90 degrees crank angle whereat the first cycle of weft insertion is initiated, the second control pin in the cylindrical section receds from the operative position into the reservoir drum and the coils of weft which have been reserved on the upstream side of the second pin are one after another subjected to delivery for the first cycle of weft insertion due to traction by the main nozzle.

At about 270 degrees crank angle, the first pin starts to recede from its operative position into the reservoir drum whereas the second control pin advances to the operative position outside the reservoir drum. During this operation, the first and second pins both move in the axial direction of the reservoir drum. More specifically, the first pin moves towards the downstream side and the second pin moves towards the upstream side so that they pass by each other on their courses of travel.

At the moment of this passing-by, the coils of weft reserved on the conical section on the upstream side of the first control pin move downstream following the movement of the first control pin, assigned to the second control pin just moving towards the upstream side, and reserved on the cylindrical section of the reservoir drum on the upstream side of the second control pin now registered at its operative position. The first control pin is required to again advance to its operative position outside the reservoir drum before the yarn guide starts to wind the first coil of weft for the third cycle of weft insertion.

In the case of the above-described type of weft reservoir in which a pair of control pins are combined in operative, there is a broader freedom in choice of the timing at which the first pin again advances towards its operative position, inasmuch as the coils of weft reserved on the conical section on the upstream side of the first control pin move on the reservoir drum towards the downstream side on recession of the first control pin into the reservoir drum. Readvance of the first control pin can take place at any moment before winding of the first coil of weft for the next (third) cycle weft insertion is started by the yarn guide.

Despite the simplified adjustment in timing of pin operation, the weft reservoir of this type is accompanied with another fatal disadvantage in assignment of weft between the control pins. At assignment of weft, the coils of weft wound on the conical section on the upstream side of the first control pin shift onto the cylindrical section which is apparently smaller in diameter than the conical section of the reservoir drum. This change in diameter of the coil of weft naturally develops abrupt slack of weft, which is apt to connect to variation in weft metering operation, unsuccessful weft insertion resulted from tangling of adjacent weft and weft slacking resulted from variation in tension. Such troubles are in particular significant when spun yarns and bemberg yarns of smaller stretch are used for the weft.

SUMMARY OF THE INVENTION

It is the object of the present invention to provide a weft reservoir with one control pin on which adjustment in movement of the control pin can be carried out easily and malign influence of weft slack at movement on the reservoir drum is minimized.

In accordance with the basic aspect of the present invention, a control pin is attached to a reservoir drum in such an arrangement as to have its operative position in the area of the conical section in order to reserve coils of weft on the conical section of the reservoir drum and the control pin is driven for a reciprocal movement between operative and stand-by positions substantially in a plane normal to the axis of the reservoir drum. That is the control pin is made to recede from the operative to stand-by position at initiation of weft insertion and, after a short dwell, the control pin is made to advance from the stand-by to operative position instantly after initiation of the weft insertion.

The control pin may be driven for movement by operation of a cam mechanism, an electro-magnetic mechanism or a hydraulic or pneumatic piston mechanism.

The control pin may move, for travel between the operative and stand-by positions, either in the radial direction or in the peripheral direction of the reservoir drum. The stand-by position for the control pin may be taken either inside (inner-type) or outside the reservoir drum. Further, for the reason described later, it is advantageous that the control pin is driven for a slight movement in the axial direction of the reservoir drum the above-described travel between the operative and stand-by positions.

DESCRIPTION OF THE PREFERRED EMBODIMENTS

Although the following description is focussed upon use of a stationary reservoir drum, the present invention is well applicable to a weft reservoir provided with a rotary reservoir drum. Further, when two sets of weft reservoirs of this invention are used in combination, the present invention is applicable to onepick alternate weaving using two sorts of wefts of different specifications.

In the accompanied drawings, mechanical parts not directly related to the present invention are omitted for simplified illustration.

Figure 1:
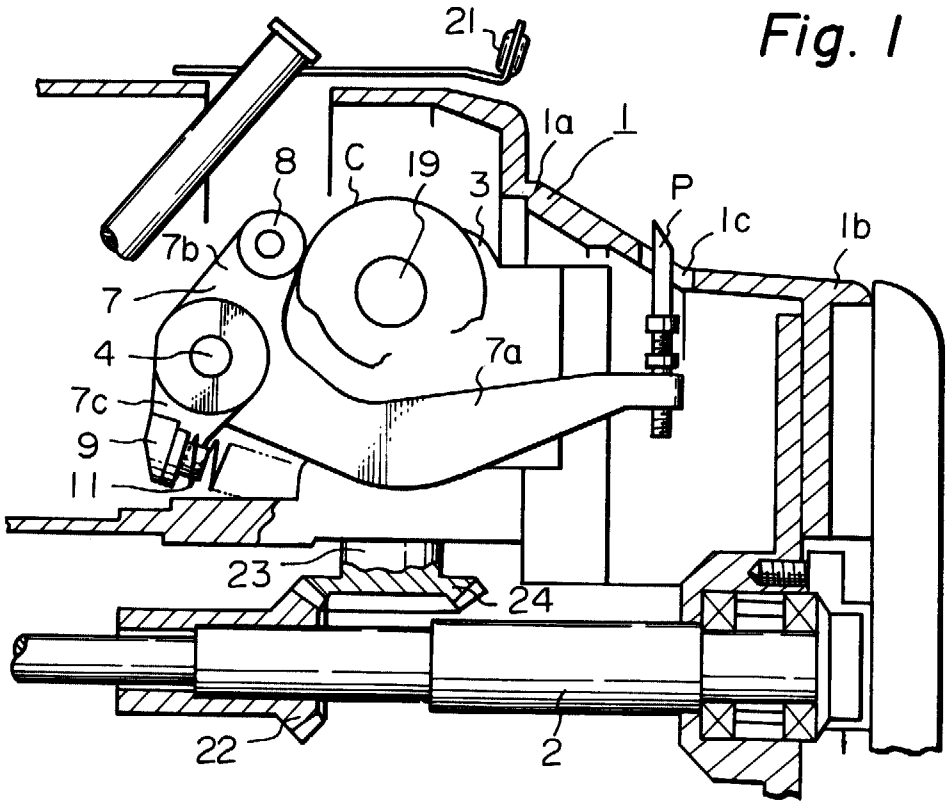
FIG. 1 is a side view, partly in section, of the first embodiment of the weft reservoir in accordance with the present invention.
Figure 2:
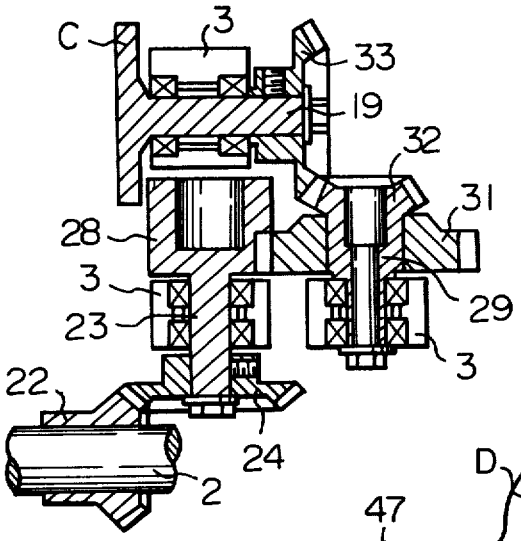
FIG. 2 is a fragmentary, sectional plan view of the weft reservoir shown in FIG. 1.

The first embodiment of the weft reservoir in accordance with the present invention is shown in FIG. 1 and 2, in which a control pin P moves in the radial and slight axial directions of the reservoir drum and its stand-by position is taken inside the reservoir drum. Further, the control pin P is driven for movement by operation of a cam mechanism.

A stationary reservoir drum 1 is made up of an upstream side conical section 1*a* and a downstream side cylindrical section 1*b* which in general tapers downstream slightly. A slot 1*c* is formed in the peripheral wall of the reservoir drum 1 whilst extending from about the downstream end of the conical section 1*a* to about the upstream end of the cylindrical section 1*b*. A main drive shaft 2 is concentrically arranged within the reservoir drum 1 whilst being rotatably supported by proper bearings secured to the reserovir drum 1.

A support shaft 4 is secured to an inner stationary framework 3 of the reservoir drum 1 whilst extending in a direction normal to the axial direction of the reservoir drum 1 and a trifurcate lever 7 is pivoted at its apex to the support shaft 4. This trifurcate lever 7 has the first branch 7*a* extending downstream, the second branch 7*b* extending upwards and the third branch 7*c* extending downwards. The above-described control pin P is secured to the distal end of the first branch 7*a* and directed towards the slot 1*c* in the peripheral wall of the reservoir drum 1. A cam follower 8 is rotatably attached to the distal end of the second branch 7*b* and a spring seat 9 is formed on the third branch 7*c*. One end of a compression spring 11 is received in the spring seat 9 on the trifurcate lever 7 and the other end in a spring seat (not shown) properly formed on the framework 3.

A cam shaft 19 is rotatably mounted on the framework 3 substantially in parallel to the above-described support shaft 4 and a cam C is secured to this cam shaft 19.

Only a part of the outline of this cam C is shown in the illustration for simplification purposes. The cam follower 8 on the trifurcate lever 7 is kept in resilient pressure contact with the periphery of this cam C by operation of the compression spring 11. As the cam shaft 19 rotates, the trifurcate lever 7 swings about the support shaft 4 and the control pin P travels between the operative and stand-by positions passing through the slot 1*C* in the peripheral wall of the reservoir drum 1. Apparently, this travel of the control pin P is a combination of a movement in the radial direction and a slight movement in the axial direction of the reservoir drum 1 as hereinafter described in more detail.

A drive mechanism for the cam C is best seen in FIG. 2. This driving is taken from the rotation of the main drive shaft 2 for the yarn guide 21 of the weft reservoir. A bevel gear 22 secured to the drive shaft 2 is kept in meshing engagement with a bevel gear 24 formed in one body with one end of the first rotary shaft which extends in the radial direction of the reservoir drum 1 and rotatably mounted on the framework 3 by means of suitable bearings. A spur gear 28 is formed in one body with the other end of the first rotary shaft 23. The second rotary shaft 29 is rotatably mounted on the framework 3 by means of suitable bearings substantially in parallel to the first rotary shaft 23. A spur gear 31 is secured to one end of the second rotary shaft 29 in meshing engagement with the spur gear 28 on the first rotary shaft. The other end of the second rotary shaft 29 is formed into a bevel gear 32 which is kept in meshing engagement with a bevel gear 33 secured to one end of the cam shaft 19. As a consequence, rotation of the main drive shaft 2 is transmitted to the cam shaft 19 via the first and second rotary shafts 23 and 29 in order to cause the rotation of the cam C, i.e. the swing motion of the trifurcate lever 7.

The weft reservoir with the above-described construction operates as follows.

As is well understood from the arrangement shown in FIG. 1, the control pin P swings along a circular path of travel whose center falls on the axis of the support shaft 4. In other words, the travel of the control pin P between the operative and stand-by positions is given in the form of a composite arc movement of a small curvature substantially in a plane normal to the axis of the reservoir drum. More specifically, the control pin P moves slightly upstream along the conical section of the reservoir drum 1 during its advance from the stand-by to operative position. Whereas, the control pin P moves slightly downstream along the conical section during its recession from the operative to stand-by position. The particulars of this arc movement of the control pin P, e.g. the timing of the movement and the pattern of the composite arc movement, can be freely adjusted by changing, for example, the profile of the cam C and the dimension of the trifurcate lever 7.

The control pin P is kept at the most advanced position during the period from just after initiation of the first cycle of weft insertion at about 130 degrees crank angle to beginning of the control delivery of weft at about 270 degrees crank angle. During this period, coils of weft for the second cycle of seft insertion are reserved on the conical section 1*a* of the reservoir drum 1 on the upstream side of the control pin P by operation of the rotary yarn guide 21.

As the control delivery of weft starts, the control pin P travels downstream from the above-described most advanced position towards the axis of the reservoir drum 1. That is the composite arc movement. Following this travel of the control pin P, the upstream side coils of weft move slightly downstream along the conical section 1*a* of the reservoir drum 1. Since the control pin P hasn't yet disappeared inwards from the periphery of the reservoir drum 1, the amount of weft reservation on the upstream side of the control pin P increases. The arc movement of the control pin P further lasts and the control pin P disappears below the periphery of the reservoir drum 1 when the second cycle of weft insertion is initiated at about 90 degrees crank angle. As a consequence, the coils of weft reserved on the upstream side conical section 1*a* are delivered due to traction of the main nozzle. The control pin P further continues its arc movement and finally arrives at the stand-by position inside the reservoir drum 1.

After a short dwell at the stand-by position, the control pin P restarts its arc movement in the opposite direction and advances to the operative position outside the reservoir drum 1 at a moment just before the rotaty yarn guide 21 comes to the operative position of the control pin P in order to form the first coil of weft for the third cycle of weft insertion. As the control pin P is registered at the operative position, coils of weft for the third cycle of weft insertion start to be reserved on the conical section of the reservoir drum 1 on the upstream side of the control pin P. The arc movement of the control pin P further lasts and the control pin P stops its movement after coming to the most advanced position at about 130 degrees crank angle. The control pin P remains standstill until the controled delivery of weft starts. In the meantime, reservation of weft continues on the upstream side of the control pin P.

In accordance with the present invention, the control pin P is driven for a reciprocal movement substantially in a plane normal to the axis of the reservoir drum from the most advanced position slightly downstream and towards the axis of the reservoir drum before its complete withdrawal of the operative position and the coils of weft reserved on the conical section of the reservoir drum on the upstream side of the control pin move slightly downstream following the above-described movement of the control pin. So, if the control pin is returned to the operative position instantly after initiation of waft insertion, the control pin is now located upstream of the coils of weft just under delivery, and coils of weft for the next cycle of weft insertion can be separately reserved on the upstream side of the control pin now brought to the operative position. Delivery of the precedent coils of weft on the downstream side and reservation of the new coils of weft on the upstream side are both totally controlled by operation of the control pin only. So, the operation of the control pin, in particular its operation timing, can be adjusted very easily and simply.

The above-described slight movement of the coils of weft takes place just when the controlled delivery starts and this obviates strong impingement of weft against the control pin around the time when weft insertion terminates. Absence of such a mechanical shock on the weft under delivery connects to stable weft insertion.

Although the coils of weft moves downstream on the reservoir drum following movement of the control pin, the travel span is an extremely short distance on the conical section only, and slack of weft caused by change in diameter is almost negligible in practice.

As is clear from the foregoing, the weft reservoir of the present invention is advantageous over the conventional weft reservoirs using either one or two control pins. In the case of the first embodiment shown in FIGS. 1 and 2, however, the stand-by position for the control pin is chosen inside the reservoir drum and the control pin advances therefrom towards the operative position taken outside the reservoir drum. Due to this arrangement, even when the control pin is kept at the operative position outside the reservoir drum, coils of weft reversed on the upstream side of the control pin tend to accidentally climb over the control pin downstream depending on the ballooning condition or shock at possible weft breakage. Once a coil of weft clims over the control pin downstream, separate reservation of weft cannot be carried out as expected. So, for reliable separate reservation of weft, such an undesirable downstream movement of coils of weft has to be restricted. In connection with this movement, the inventor of this invention watched the fact that, when a coil of weft climbs over the control pin, it floats radially outwards from the surface of the reservoir drum. If there is something near the surface of the reservoir drum which always catches such a coil of weft floating from the surface of the reservoir drum, the above-described undesirable downstream movement of the coil of weft beyond the control pin can be effectively restricted. On the basis of this concept, it is proposed in the second embodiment of the present invention to take the stand-by position for the control pin on the outer side of the operative position on the peripheral surface of the reservoir drum. In other words, the control pin is always located outside the reservoir drum with its point being always directed to the peripheral surface of the reservoir drum. This arrangement enables the control pin to always catch a coil of weft floating outwards from the surface of the reservoir drum and restricts its downstream movement.

Figure 3:
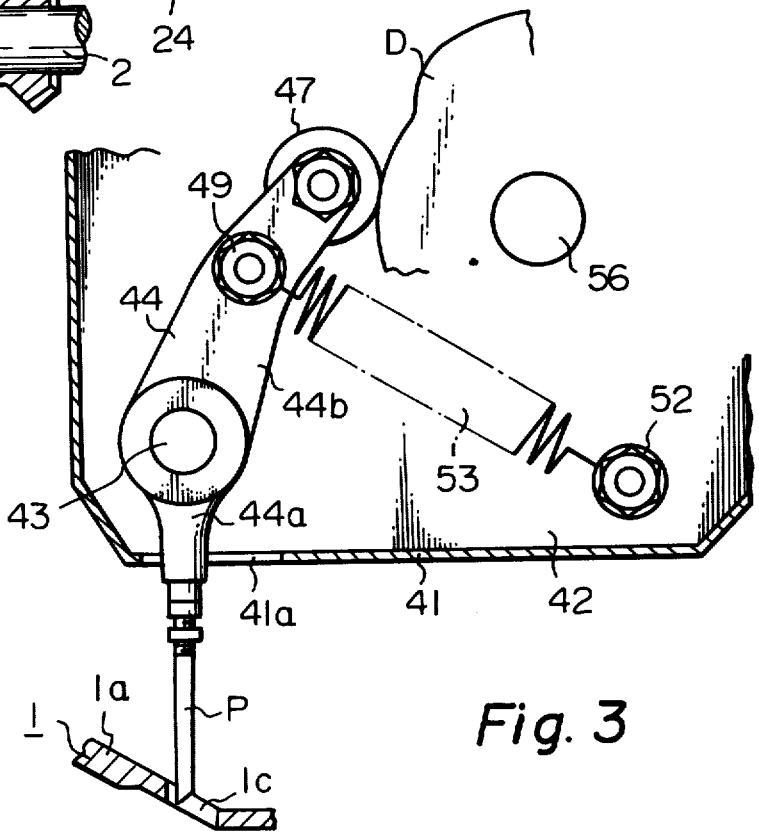
FIG. 3 is a simplified side view, partly in section, of the second embodiment of the weft reservoir in accordance with the present invention.

The second embodiment of the weft reservoir having this construction (external type) in accordance with the present invention is shown in FIG. 3.

A magazine 41 is secured to a suitable framework (not shown) arranged outside the reservoir drum 1 and a cam D for driving the control pin P for composite arc movement is arranged within the magazine 41. Only a part of the outline of the cam D is shown in the illustration. The magazine 41 is provided with a slot 41*a* formed in its wall facing the reservoir drum 1. This slot 41*a* extends in parallel to the axial direction of the reservoir drum 1 and the control pin P is directed, through this slot 41*a*, to the peripheral surface of the reservoir drum 1.

In general, the point of the control pin P should be located in the close proximity of the peripheral surface of the reservoir drum 1. However, presence of a gap, even a very small one, between the point of the control pin and the peripheral surface of the reservoir drum may allow accidental passage through the gap of coils of weft reserved on the upstream side of the control pin. This also disturbs separate reservation of weft on the reservoir drum 1. In order to restrict such accidental passage of the upstream coils of weft, the arrangement in FIG. 3 is contructed so that, when the control pin P is registered at the most advanced position, its point should slightly intrude into the slot 1*c* formed in the peripheral wall of the reservoir drum 1.

A support shaft 43 is secured to an internal framework 42 of the magazine 41 whilst extending in a direction substantially normal to the axial direction of the reservoir drum 1 and a bifurcate lever 44 is idly inserted over this support shaft 43. The control pin P is secured to the distal end of the first branch 44*a* of this bifurcate lever 44 and a cam follower 47 is rotatably mounted on the distal end of the second branch 44*b* of this bifurcate lever 44. A spring seat 49 is formed at a proper position on the second branch 44*b* a tension spring 53 is interposed between this spring seat 49 and another spring seat 52 properly formed on the framework 42.

A cam shaft 56 is rotatably mounted to the framework 42 substantially in parallel on the support shaft 43 and the above-described cam D is securedly inserted over this cam shaft 56. This cam shaft 56 is coupled in operation to a proper external source of drive such as the drive shaft 2 (see FIG. 2) for the yarn guide via a known intermediate transmission. The cam follower 47 is kept in resilient pressure contact with the cam D by operation of the tension spring 53.

The mode of operation of the control pin P is substantially the same as that of the control pin in the first embodiment shown in FIGS. 1 and 2. In this case, however, the control pin P advances towards the operative position on the reservoir drum 1 from a stand-by position located radially on the outer side of the operative position. So, even when coils of weft on the upstream side float radially outwards from the surface of the reservoir drum, their downstream movement is well blocked by the constant presence of the control pin on the radially outerside of the operative position.

In either of the foregoing embodiments, the control pin P is driven for a composite arc movement which is a combination of a movement in the radial direction with a movement in the axial direction of the reservoir drum. Such a composite arc movement of the control pin is most advantageous from the viewpoint of reduction in mecchanical shock acting on the weft to be reserved and delivered. It should be noted, however, that it is not necessarily required for the control pin to perform such a composite movement if acting of some extent of mechanical shock on the weft is admitted. In other words, the basic object of the present invention can be attained only if the control pin is driven for movement in the radial direction of the reservoir drum even without combination with the axial movement.

Figure 4:
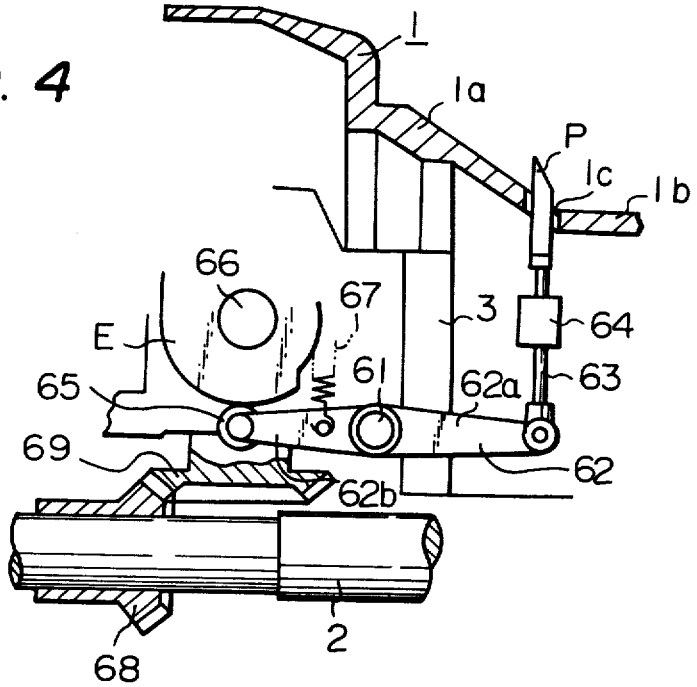
FIG. 4 is a simplified side view, partly in section, of the third embodiment of the weft reservoir in accordance with the present invention.

The third embodiment of the present invention shown in FIG. 4 is constructed on the basis of such a concept. A support shaft 61 is securedly mounted on the inner framework 3 of the reservoir drum 1 whilst extending in a direction substantially normal to the axial direction of the reservoir drum 1 and a bifurcate lever 62 is idly inserted at about its middle over the support shaft 61. The distal end of the first branch 62*a* of this bifurcate lever 62 is pivoted to a shifter rod 63 which in turn securedly hold a control pin P directed to the slot 1C in the peripheral wall of the reservoir drum 1. The shifter rod 63 is kept in sliding engagement with a guide 64 on the framework 3 in order to assure an exact radial movement of the control pin P. A cam follower 65 is rotatably coupled to the distal end of the second branch 62*b* of the bifurcate lever 62.

A cam shaft 66 is rotatably mounted to the framework 3 substantially in parallel on the support shaft 61, and a cam E is securedly inserted over the cam shaft 66. Only a part of the outline of the cam E is shown in the illustration. A tension spring 67 is interposed between a spring seat formed on the second branch 62*b* of the bifurcate lever 62 and another spring seat (not shown) arranged on the framework 3 in order to keep the cam follower 65 in resilient pressure contact with the cam E on the cam shaft 66. Just like the arrangement shown in FIG. 2, the cam shaft 66 is related in rotation to the drive shaft 2 for the yarn guide via a bevel gear 68 on the drive shaft 2 and a bevel gear 69 placed in meshing engagement with the bevel gear 68. Except for absence of the movement in the axial direction of the reservoir drum 1, the mode of operation, in particular the timing of operation, performed by the control pin is almost the same as those of the foregoing embodiments.

In the case of this embodiment, the control pin P does not move in the axial direction of the reservoir drum 1 and, as a consequence, the coils of weft reserved on the upstream side of the control pin P do not move before the control pin P disappears into the interior of the reservoir drum 1. However, they move slightly from the conical to cylindrical section when the control pin has receded from its operative position. So, the control pin is allowed to advance to the opperative position again at any time after the coils of weft has performed the above-described slight movement and before the yarn guide comes to the position of the control pin for formation of the first coil of weft for the next cycle of weft insertion. This broader freedom in choice of time for reappearance greatly simplifies adjustment in operation of the control pin P.

When the coils of weft perform the above-described slight movement from the conical to straight section, a slight slack may be developed on the weft due to difference in diameter. In practice, however, the weft is instantly subjected to delivery due to traction by the main nozzle right after weft-insertion is initiated and, as a consequence, the slack has no virtual influence on behavior of the weft.

In a modification of the arrangement shown in FIG. 4, the cam drive mechanism may be arranged outside the reservoir drum 1 as in FIG. 3 in order to prevent accidental climbing over of the coils of weft beyond the control pin P. In this case, a construction substantially the same as the one shown in FIG. 4 may be encased in a magazine properly arranged outside the reservoir drum and the control pin P advances towards the operative position on the reservoir drum from a stand-by position located radially on the outer side of the operative position. In this case, the mode of operation of the control pin P is quite the same as that in FIG. 4.

In the case of the foregoing embodiment, travel of the control pin P between the operative and stand-by positions is carried out in two different ways. In FIGS. 1 to 3, the control pin P is driven for a composite arc movement which is a combination of a movement in the radial direction with a movement in the axial direction of the reservoir drum. Whereas, in FIG. 4 and its modification, the control pin P is driven for a movement in the radial direction of the reservoir drum only. However, shift of the control pin between the operative and stand-by positions may be carried out by driving for a movement in the circumferential direction of the reservoir drum 1 also. One embodiment of the present invention constructed on the basis of this concept is shown in FIG. 5.

A slot 1*d* is formed in the peripheral wall of the reservoir drum 1 whilst extending in the circumferential direction of the reservoir drum 1 so that the control pin P should advance towards the operative position outside the reservoir drum 1 through this slot 1*d*. A support shaft 71 is secured to the inner framework 3 of the reservoir drum 1 substantially in parallel to the main drive shaft 2 for the yarn guide 21. A bifurcate lever 72 is idly inserted at its apex over the support shaft 71. The first branch 72*a* of the bifurcate lever 72 securedly holds a control pin P whereas the second branch 72*b* rotatably carries a cam follower 73. A tension spring 75 is interposed between a spring seat formed on the first branch 72*a* and another spring seat (not shown) properly arranged on the framework 3. A cam shaft 74 is rotatably mounted on the framework 3 substantially in parallel on the support shaft 71 and a cam F is securedly inserted over the cam shaft 74. Only a part of the outline of the cam F is shown in the illustration. The cam follower 73 is kept in resilient pressure contact with the cam F by operation of the tension spring 75. A spur gear 76 is securedly mounted on the cam shaft 74 in meshing engagement with another spur gear 77 secured to the main drive shaft 2.

Upon rotation of the drive shaft 2, the cam F rotates about the axis of the cam shaft 74 and the control pin P swings in the circumferential direction of the reservoir drum 1 as shown with an arrow.

Figure 5:
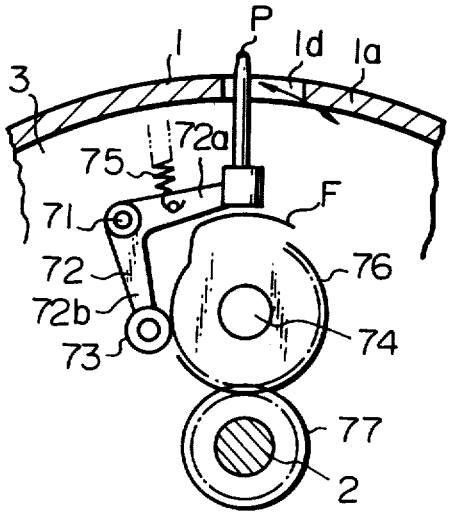
FIG. 5 is a simplified side view of the fourth embodiment of the weft reservoir in accordance with the present invention.

In one modification of the construction shown in FIG. 5, the cam drive mechanism may be encased in a magazine properly arranged outside the reservoir drum 1. In such a case, the control pin P advances towards the operative position on the reservoir drum from a stand-by position located on the radially outer side of the operative position whilst moving in the circumferential direction of the reservoir drum 1.

In any case, the control pin advances towards and recedes from the operative position taken on the conical section of the reservoir drum. As a consequence, coils of weft moves slightly downstream on the conical section as the control pin recedes from the operative position at initiation of weft insertion so that the control pin can be again registered at the operative position instantly after initiation of the weft insertion. This greatly simplifies adjustment in operation of the control pin. In addition, since delivery of weft starts concurrently with recession of the control pin from the operative position, slack of weft caused by difference in diameter has no virtual influence in practice on behavior of the weft at reservation and delivery.

I claim:

1. A weft reservoir for fluid jet looms in which weft is reserved under pin control comprising a reservoir drum made up of an upstream side conical section and a downstream side cylindrical section, a yarn guide rotatable about said reservoir drum for supply of weft taken from a given source of supply, a control pin annexed to said reservoir drum with its point being directed to an operative position taken on said conical section of said reservoir drum, and means for driving said control pin for a reciprocal movement substantially in a plane normal to the axis of said reservoir drum between said operative position and a stand-by position in synchronism with loom running in such a manner that said control pin recedes from said operative position to said stand-by position upon initiation of weft insertion for delivery of weft reserved on its upstream side, and after a short dwell, advances again to said operative position from said stand-by position instantly after said initiation of weft insertion.

2. A weft reservoir as claimed in claim 1 in which said control pin starts to recede from its most advanced position upon initiation of controlled delivery of said weft.

3. A weft reservoir as claimed in claim 1 in which said driving means includes a cam drive mechanism.

4. A weft reservoir as claimed in claim 1, 2 or 3 in which said control pin is driven for movement in the radial direction of said reservoir drum.

5. A weft reservoir as claimed in claim 4 in which said stand-by position for said control pin is taken radially inside said reservoir drum.

6. A weft reservoir as claimed in claim 4 in which said stand-by position for said control pin is taken radially on the outer side of said operative position on said reservoir drum.

7. A weft reservoir as claimed in claim 1, 2 or 3 in which said control pin is driven for a composite arc movement which is a combination of a movement in the radial direction with a movement in the axial direction of said reservoir drum.

8. A weft reservoir as claimed in claim 7 in which said stand-by position for said control pin is taken radially inside said reservoir drum.

9. A weft reservoir as claimed in claim 7 in which said stand-by position for said control pin is taken radially on the outer side of said operative position on said reservoir drum.

10. A weft reservoir as claimed in claim 1, 2 or 3 in which said control pin is driven for movement in the circumferential direction of said reservoir drum.

11. A weft reservoir as claimed in claim 10 in which said stand-by position for said control pin is taken radially inside said reservoir drum.

12. A weft reservoir as claimed in claim 10 in which said stand-by position for said control pin is taken radially on the outer side of said operative position on said reservoir drum.

13. A weft reservoir as claimed in claim 3 in which said cam drive mechanism includes a main drive shaft for said yarn guide arranged rotatably and concentrically in said reservoir drum, a framework arranged in a fixed relationship to said reserfoir drum, a support shaft secured to said framework, a lever pivoted at apex to said support shaft and having a first branch holding said control pin and a second branch rotatably holding a cam follower, a cam shaft rotatably mounted to said framework substantially in parallel to said support shaft, a cam secured to said cam shaft, means for keeping said cam follower in resilient pressure contact with said cam, and means for transmitting rotation of said main drive shaft to said cam shaft.

14. A weft reservoir as claimed in claim 1, 2 or 3, wherein said control pin consists of one control pin.

15. A weft reservoir as claimed in claim 14, wherein said control pin recedes and advances at a fixed position on said conical section.

* * * * *

UNITED STATES PATENT AND TRADEMARK OFFICE

CERTIFICATE OF CORRECTION

PATENT NO. : 4,481,983

DATED : November 13, 1984

INVENTOR(S) : Yujiro Takegawa

It is certified that error appears in the above-identified patent and that said Letters Patent are hereby corrected as shown below:

Column 2:

Line 26, change "cylce" to --cycle--;

Line 27, change "pactice" to --practice--;

Line 54, change "receds" to --recedes--.

Column 3:

Line 15, change "operative" to --operation--.

Column 4:

Line 4, after "drum" insert --during--.

Column 5:

Line 58, after "this" insert --composite--;

Line 60, delete "composite".

UNITED STATES PATENT AND TRADEMARK OFFICE

CERTIFICATE OF CORRECTION

PATENT NO. : 4,481,983

DATED : November 13, 1984

INVENTOR(S) : Yujiro Takegawa

It is certified that error appears in the above-identified patent and that said Letters Patent are hereby corrected as shown below:

Column 7:

Line 16, change "reversed" to --reserved--.

Column 8:

Line 42, change "mecchanical" to --mechanical--.

Signed and Sealed this

*Fourth* Day of *June 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,481,983

DATED : November 13, 1984

INVENTOR(S) : Yujiro Takegawa

It is certified that error appears in the above-identified patent and that said Letters Patent are hereby corrected as shown below:

On the title page:

In the identification of the assignee "Tsudakomo Kogyo Kabushiki Kaisha" should read --Tsudakoma Kogyo Kabushiki Kaisha--.

Signed and Sealed this

Twenty-first Day of October, 1986

[SEAL]

*Attest:*

DONALD J. QUIGG

*Attesting Officer* *Commissioner of Patents and Trademarks*